US011430416B1

(12) United States Patent
Brown et al.

(10) Patent No.: US 11,430,416 B1
(45) Date of Patent: Aug. 30, 2022

(54) PLECTRUM SHEATH DESIGNED TO RETAIN A SINGLE PLECTRUM

(71) Applicants: Gerald Francis Brown, Chapel Hill, NC (US); Isaac Daniel Derr, Chapel Hill, NC (US)

(72) Inventors: Gerald Francis Brown, Chapel Hill, NC (US); Isaac Daniel Derr, Chapel Hill, NC (US)

( * ) Notice: Subject to any disclaimer, the term of this patent is extended or adjusted under 35 U.S.C. 154(b) by 0 days.

(21) Appl. No.: 17/575,989

(22) Filed: Jan. 14, 2022

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS

| | | | | |
|---|---|---|---|---|
| 7,626,103 | B1 * | 12/2009 | Phillips | G10D 3/173 84/320 |
| D877,460 | S * | 3/2020 | Patton | D2/841 |
| D895,267 | S * | 9/2020 | Leatham | D3/204 |
| 2006/0096440 | A1 * | 5/2006 | Weathersby | G10D 3/173 84/322 |

FOREIGN PATENT DOCUMENTS

| | | | | |
|---|---|---|---|---|
| GB | 2208255 | A * | 3/1989 | G10D 3/163 |

* cited by examiner

*Primary Examiner* — Jianchun Qin
(74) *Attorney, Agent, or Firm* — Gerald Brown

(57) ABSTRACT

A plectrum sheath made of a rigid material designed to retain a single plectrum, having a thin wide opening at the top and a closure at the bottom. Two clip springs are built into the device due to the nature of its fabrication. These clip springs provide downward spring tension that holds a plectrum firmly in place once the plectrum is fully inserted into the plectrum sheath.

5 Claims, 1 Drawing Sheet

PLECTRUM SHEATH DESIGNED TO RETAIN A SINGLE PLECTRUM

FIELD OF INVENTION

The invention relates to a device designed to retain a single plectrum for the purpose of not losing said plectrum.

BACKGROUND

It is known to the art that plectrums (also referred to as a pick) can have significant financial, superstitious, and emotional value to the musicians that own and use them. Many musicians own plectrums made of expensive materials like vespel, simply have a favorite pick, or own a priceless antique tortoise shell pick. These musicians, unlike many others, do not view picks as a semi-disposable resource but instead as a prize possession.

A SHORT SUMMARY OF THE INVENTION

The present invention serves the needs of these musicians by storing a single pick in a manner that ensures its safe keeping. The present invention could be worn as a piece of jewelry or affixed to a personal belonging like a wallet or phone, this way a musician always has their favorite plectrum with them.

The present invention is a bent piece of flat material comprising two bends of slightly more than 180 deg. Creating an envelope-like enclosure. The two aforementioned bends are dimensioned to create a triangular enclosure forming a thin wide opening at the top of the device that tapers down to a natural closure at the bottom point of the triangle. These two bends and the unbent flat back of the envelope-like enclosure create two semi-rigid clip springs that, in conjunction with a small insertion hole located on the flat back of the envelope, allow the flat profile of a plectrum to be easily slid into the opening of the device but disallow the plectrum from becoming accidentally dislodged from the device. The termination of these clip springs forms a vertical centerline down the front face of the device so there is little to no gap between them. The taper of the clip springs increases the amount of leverage applied by their spring action as the plectrum is further inserted into the device. This increase of leverage ensures that a fully inserted plectrum is held firmly in the device. In order to allow the user to remove their plectrum and reduce the overall spring tension applied to a fully inserted plectrum, two openings have been made that extend from the seam of the bends inward towards the center of the triangular front face of the device. These openings allow the user to simultaneously pinch the exposed left and right edges of a fully inserted plectrum, forcing the plectrum up and out of the device.

These and other embodiments, advantages, and features of this invention will be apparent from the following description, drawings, and appended claims.

DETAILED DESCRIPTION

Figure 1:
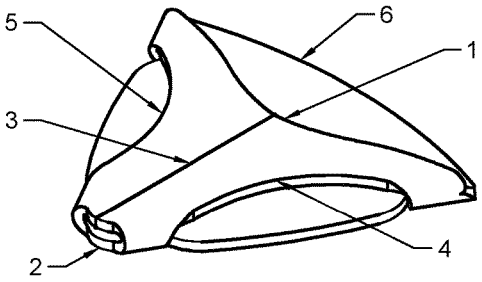
FIG. 1. An isometric view of the invention.

The present invention is a bent piece of flat material comprising two bends of slightly more than 180 deg that create an envelope-like enclosure. The invention has the general profile of an equilateral triangle, created by the two bends, each bend having a bend line that converges at a point. The point at which these two lines converge will henceforth be referred to as the tip of the invention. The remaining side of the triangular profile, tangent to the tip of the invention and not having a bend, will henceforth be referred to as the opening of the invention. When fully formed the device comprises a solid back face and two pieces of material, connected to the solid back face by the aforementioned bends, that create a bisected front face. Between the front and back faces is a void where a single plectrum could reside. At the tip of the invention, where the bend lines converge, the available space becomes significantly smaller than the plectrum, disallowing it to slip out the tip of the device. As the bends of the invention diverge a thin wide opening is created directly opposite to the tip of the invention. This opening is large enough to accept the vast majority of plectrums used by musicians today. These two bends and the unbent back face of the envelope-like enclosure further create two semi-rigid clip springs each being biased towards the back face.

The termination of these clip springs forms a vertical centerline down the front face of the device thus bisecting the front face of the device. The converging bend lines in combination with the centerline formed by the meeting of the two clip springs is designed to apply increasing spring tension to the plectrum as it is pushed further into the device due to an increase in the leverage applied to the plectrum by the clip springs. This increase in spring tension is caused by said leverage being lesser where the centerline is further from the bend lines and greater where the centerline is closer to the bend lines. This increased spring tension ensures that a fully inserted plectrum cannot, without the direct intent of the user, become separated from the invention.

A triangular insertion hole is cut into the back face directly beneath the centerline of the bisected front face and is partially visible from the opening of the device. A side of the triangular insertion hole faces the opening and a point of the triangular insertion hole faces the tip of the device. This insertion hole allows the tip of the plectrum to initially be inserted under no spring tension. However, as the plectrum is inserted further into the opening of the device, the triangular shape of the insertion hole forces the tip of the plectrum out of the Triangular insertion hole and into contact with the clip springs that form the bisected front face. This insertion point allows the flat profile of a plectrum to be easily slid into the opening at first, but, as the plectrum is slid into the device, the amount of spring tension applied to the plectrum gradually increases. This increase in spring tension disallows the plectrum from becoming unintentionally dislodged from the device, as the plectrum is firmly pressed against the back face of the invention by the two clip springs that form the bisected front face.

In order to allow the user to remove their plectrum and reduce the overall spring tension applied to a fully inserted plectrum, two openings have been made that extend from the seam of the bends inward towards the centerline of the bisected front face of the device. These openings allow the user to simultaneously pinch the exposed left and right edges of a fully inserted plectrum, gradually decreasing the spring tension applied to the plectrum as it is pushed up and out of the device.

The Figures represent particular embodiments, and are not intended to be construed as limiting the invention.

Referring now to the Figures,

FIG. 1 is an isometric view of an embodiment of the invention showing the opening 1, the tip 2, the centerline 3 where the two clip springs 4, 5 meet to form the bisected front face, and the back face of the invention 6.

Figure 2:
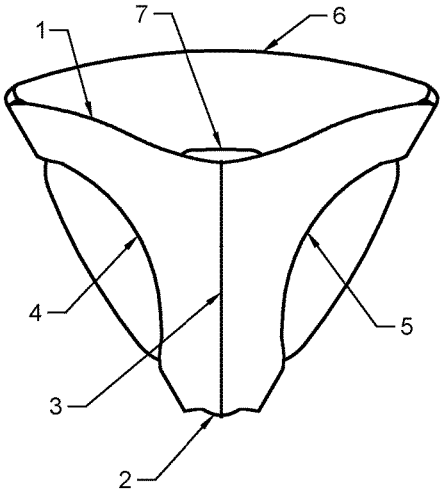
FIG. 2. A top down view of the invention's front face.

FIG. 2 is a top down view of an embodiment of the invention showing the opening 1, the tip 2, the centerline 3 where the two clip springs 4-5 meet to form the bisected front face, the back face of the invention 6, and part of the insertion hole 7.

Figure 3:
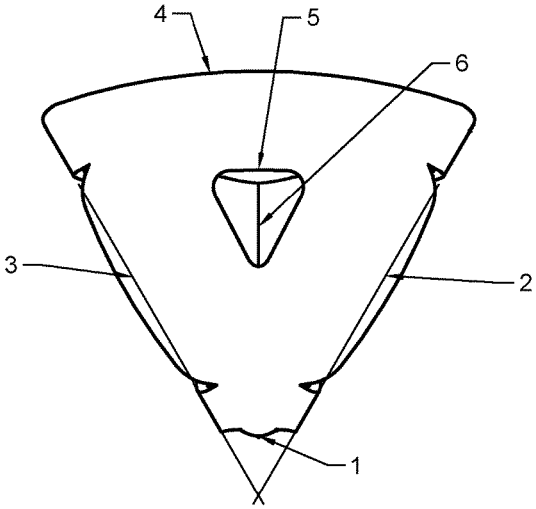
FIG. 3. A top down view of the invention's back face.

FIG. 3 is a top down view of an embodiment of the invention showing the tip 1, the bend lines of the spring clips 2-3, the back face 4, the triangular insertion hole 5, and the centerline where the two clip springs meet 6.

Figure 4:
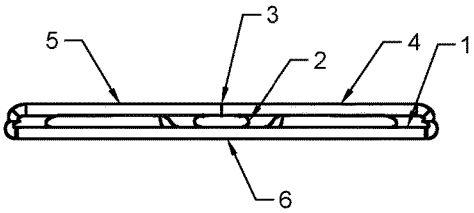
FIG. 4. A side view of the opening of the invention.

FIG. 4 is a side view of an embodiment of the invention showing the opening 1, the tip 2, the centerline where the two spring clips meet 3, the two spring clips 4-5 that form the front face of the invention, and the back face of the invention 6.

The invention claimed is:

1. A bent piece of flat material comprising two bends dimensioned to create a triangular envelope-like enclosure having a front and rear face that form a thin wide opening at the top of the invention that tapers down to a natural closure at the bottom point of the triangle with said bends being formed so that the terminus of the bend is closer to the rear face of the enclosure than it is at the hinge point of the bend, in doing so two clip springs are created, inserting a plectrum into the invention flexes these clip springs causing spring tension to hold the plectrum within the invention.

2. The clip springs of claim 1, being dimensioned so that neither one overlaps the other but instead terminates to form a vertical centerline that bisects the front face of the invention.

3. The clip springs of claim 1, being designed to apply increasing spring tension to the plectrum as it is pushed further into the device due to the leverage on the plectrum being lesser where the terminus of the clip springs are further from the hinge point of the clip springs at the opening of the invention and closer to the hinge point at the tip of the invention.

4. The clip springs of claim 1, each having an opening dimensioned to allow the user to pinch the exposed edges of a fully inserted plectrum in order to remove the plectrum from the invention, but each opening also being dimensioned so that the plectrum cannot escape the invention via the openings cut into the clip springs.

5. A small insertion hole in the rear face of claim 1, dimensioned to accept the tip of the plectrum between the front face/clip springs of the invention and the rear face of the invention by allowing the plectrum to be initially inserted not under spring tension and then, as the user inserts the plectrum, gradually increase the spring tension on the plectrum.

* * * * *